US007755595B2

(12) United States Patent
Ferguson

(10) Patent No.: US 7,755,595 B2
(45) Date of Patent: Jul. 13, 2010

(54) DUAL-SLOPE BRIGHTNESS CONTROL FOR TRANSFLECTIVE DISPLAYS

(75) Inventor: Bruce R. Ferguson, Anaheim, CA (US)

(73) Assignee: Microsemi Corporation, Irvine, CA (US)

( * ) Notice: Subject to any disclaimer, the term of this patent is extended or adjusted under 35 U.S.C. 154(b) by 1437 days.

(21) Appl. No.: 11/145,877

(22) Filed: Jun. 6, 2005

(65) Prior Publication Data

US 2006/0007107 A1 Jan. 12, 2006

Related U.S. Application Data

(60) Provisional application No. 60/577,645, filed on Jun. 7, 2004.

(51) Int. Cl.
*G09G 3/36* (2006.01)

(52) U.S. Cl. ..... 345/102

(58) Field of Classification Search ..... 345/102, 345/103, 104, 87
See application file for complete search history.

(56) References Cited

U.S. PATENT DOCUMENTS

| | | | |
|---|---|---|---|
| 2,429,162 | A | 10/1947 | Russell et al. |
| 2,440,984 | A | 5/1948 | Summers |
| 2,572,258 | A | 10/1951 | Goldfield et al. |
| 2,965,799 | A | 12/1960 | Brooks et al. |
| 2,968,028 | A | 1/1961 | Eilichi et al. |
| 3,141,112 | A | 7/1964 | Eppert |
| 3,449,629 | A | 6/1969 | Wigert et al. |
| 3,565,806 | A | 2/1971 | Ross |
| 3,597,656 | A | 8/1971 | Douglas |
| 3,611,021 | A | 10/1971 | Wallace |
| 3,683,923 | A | 8/1972 | Anderson |
| 3,737,755 | A | 6/1973 | Calkin et al. |
| 3,742,330 | A | 6/1973 | Hodges et al. |
| 3,916,283 | A | 10/1975 | Burrows |
| 3,936,696 | A | 2/1976 | Gray |
| 3,944,888 | A | 3/1976 | Clark |
| 4,053,813 | A | 10/1977 | Komrumpf et al. |
| 4,060,751 | A | 11/1977 | Anderson |
| 4,204,141 | A | 5/1980 | Nuver |
| 4,277,728 | A | 7/1981 | Stevens |
| 4,307,441 | A | 12/1981 | Bello |

(Continued)

FOREIGN PATENT DOCUMENTS

| | | |
|---|---|---|
| EP | 0326114 | 8/1989 |

(Continued)

OTHER PUBLICATIONS

Jordan et al., Resonant Fluorescent Lamp Converter Provides Efficient and Compact Solution, Mar. 1993, pp. 424-431.

(Continued)

*Primary Examiner*—Amr Awad
*Assistant Examiner*—Yong Sim
(74) *Attorney, Agent, or Firm*—Knobbe, Martens, Olson & Bear, LLP

(57) ABSTRACT

A backlight intensity for a transflective display increases proportionately with increasing ambient light levels for a first range of ambient light levels and decreases proportionately with increasing ambient levels for a second range of ambient light levels to improve power efficiency. The second range of ambient light levels is higher than the first range of ambient light levels.

8 Claims, 2 Drawing Sheets

U.S. PATENT DOCUMENTS

| | | | |
|---|---|---|---|
| 4,353,009 | A | 10/1982 | Knoll |
| 4,388,562 | A | 6/1983 | Josephson |
| 4,392,087 | A | 7/1983 | Zansky |
| 4,437,042 | A | 3/1984 | Morais et al. |
| 4,441,054 | A | 4/1984 | Bay |
| 4,463,287 | A | 7/1984 | Pitel |
| 4,469,988 | A | 9/1984 | Cronin |
| 4,480,201 | A | 10/1984 | Jaeschke |
| 4,523,130 | A | 6/1985 | Pitel |
| 4,543,522 | A | 9/1985 | Moreau |
| 4,544,863 | A | 10/1985 | Hashimoto |
| 4,555,673 | A | 11/1985 | Huijsing et al. |
| 4,562,338 | A | 12/1985 | Okami |
| 4,567,379 | A | 1/1986 | Corey et al. |
| 4,572,992 | A | 2/1986 | Masaki |
| 4,574,222 | A | 3/1986 | Anderson |
| 4,585,974 | A | 4/1986 | Stupp et al. |
| 4,622,496 | A | 11/1986 | Dattilo et al. |
| 4,626,770 | A | 12/1986 | Price, Jr. |
| 4,630,005 | A | 12/1986 | Clegg et al. |
| 4,663,566 | A | 5/1987 | Nagano |
| 4,663,570 | A | 5/1987 | Luchaco et al. |
| 4,672,300 | A | 6/1987 | Harper |
| 4,675,574 | A | 6/1987 | Delflache |
| 4,682,080 | A | 7/1987 | Ogawa et al. |
| 4,686,615 | A | 8/1987 | Ferguson |
| 4,689,802 | A | 8/1987 | McCambridge |
| 4,698,554 | A | 10/1987 | Stupp et al. |
| 4,700,113 | A | 10/1987 | Stupp et al. |
| 4,717,863 | A | 1/1988 | Zeiler |
| 4,745,339 | A | 5/1988 | Izawa et al. |
| 4,761,722 | A | 8/1988 | Pruitt |
| 4,766,353 | A | 8/1988 | Burgess |
| 4,779,037 | A | 10/1988 | LoCascio |
| 4,780,696 | A | 10/1988 | Jirka |
| 4,792,747 | A | 12/1988 | Schroeder |
| 4,812,781 | A | 3/1989 | Regnier |
| 4,847,745 | A | 7/1989 | Shekhawat |
| 4,862,059 | A | 8/1989 | Tominaga et al. |
| 4,885,486 | A | 12/1989 | Shekhawat et al. |
| 4,893,069 | A | 1/1990 | Harada et al. |
| 4,902,942 | A | 2/1990 | El-Hamamsy et al. |
| 4,939,381 | A | 7/1990 | Shibata et al. |
| 4,998,046 | A | 3/1991 | Lester |
| 5,023,519 | A | 6/1991 | Jensen |
| 5,030,887 | A | 7/1991 | Guisinger |
| 5,036,255 | A | 7/1991 | McKnight et al. |
| 5,049,790 | A | 9/1991 | Herfurth et al. |
| 5,057,808 | A | 10/1991 | Dhyanchand |
| 5,083,065 | A | 1/1992 | Sakata et al. |
| 5,089,748 | A | 2/1992 | Ihms |
| 5,105,127 | A | 4/1992 | Lavaud et al. |
| 5,130,565 | A | 7/1992 | Girmay |
| 5,130,635 | A | 7/1992 | Kase |
| 5,173,643 | A | 12/1992 | Sullivan et al. |
| 5,220,272 | A | 6/1993 | Nelson |
| 5,235,254 | A | 8/1993 | Ho |
| 5,289,051 | A | 2/1994 | Zitta |
| 5,317,401 | A | 5/1994 | Dupont et al. |
| 5,327,028 | A | 7/1994 | Yum et al. |
| 5,349,272 | A | 9/1994 | Rector |
| 5,406,305 | A | 4/1995 | Shimomura et al. |
| 5,410,221 | A | 4/1995 | Mattas et al. |
| 5,420,779 | A | 5/1995 | Payne |
| 5,430,641 | A | 7/1995 | Kates |
| 5,434,477 | A | 7/1995 | Crouse et al. |
| 5,440,208 | A | 8/1995 | Uskali et al. |
| 5,463,287 | A | 10/1995 | Kurihara et al. |
| 5,471,130 | A | 11/1995 | Agiman |
| 5,475,284 | A | 12/1995 | Lester et al. |
| 5,475,285 | A | 12/1995 | Konopka |
| 5,479,337 | A | 12/1995 | Voigt |
| 5,485,057 | A | 1/1996 | Smallwood et al. |
| 5,485,059 | A | 1/1996 | Yamashita et al. |
| 5,485,487 | A | 1/1996 | Orbach et al. |
| 5,493,183 | A | 2/1996 | Kimball |
| 5,495,405 | A | 2/1996 | Fujimura et al. |
| 5,510,974 | A | 4/1996 | Gu et al. |
| 5,514,947 | A | 5/1996 | Berg |
| 5,519,289 | A | 5/1996 | Katyl et al. |
| 5,528,192 | A | 6/1996 | Agiman |
| 5,539,281 | A | 7/1996 | Shackle et al. |
| 5,548,189 | A | 8/1996 | Williams |
| 5,552,697 | A | 9/1996 | Chan |
| 5,557,249 | A | 9/1996 | Reynal |
| 5,563,473 | A | 10/1996 | Mattas et al. |
| 5,563,501 | A | 10/1996 | Chan |
| 5,574,335 | A | 11/1996 | Sun |
| 5,574,356 | A | 11/1996 | Parker |
| 5,608,312 | A | 3/1997 | Wallace |
| 5,612,594 | A | 3/1997 | Maheshwari |
| 5,612,595 | A | 3/1997 | Maheshwari |
| 5,615,093 | A | 3/1997 | Nalbant |
| 5,619,104 | A | 4/1997 | Eunghwa |
| 5,619,402 | A | 4/1997 | Liu |
| 5,621,281 | A | 4/1997 | Kawabata et al. |
| 5,629,588 | A | 5/1997 | Oda et al. |
| 5,635,799 | A | 6/1997 | Hesterman |
| 5,652,479 | A | 7/1997 | LoCascio et al. |
| 5,663,613 | A | 9/1997 | Yamashita et al. |
| 5,705,877 | A | 1/1998 | Shimada |
| 5,710,489 | A | 1/1998 | Nilssen |
| 5,712,533 | A | 1/1998 | Corti |
| 5,712,776 | A | 1/1998 | Palara et al. |
| 5,719,474 | A | 2/1998 | Vitello |
| 5,744,915 | A | 4/1998 | Nilssen |
| 5,748,460 | A | 5/1998 | Ishihawa |
| 5,751,115 | A | 5/1998 | Jayaraman et al. |
| 5,751,120 | A | 5/1998 | Zeitler et al. |
| 5,751,560 | A | 5/1998 | Yokoyama |
| 5,754,012 | A | 5/1998 | LoCascio |
| 5,754,013 | A | 5/1998 | Praiswater |
| 5,760,760 | A | 6/1998 | Helms |
| 5,770,925 | A | 6/1998 | Konopka et al. |
| 5,777,439 | A | 7/1998 | Hua |
| 5,786,801 | A | 7/1998 | Ichise |
| 5,796,213 | A | 8/1998 | Kawasaki |
| 5,808,422 | A | 9/1998 | Venkitasubrahmanian et al. |
| 5,818,172 | A | 10/1998 | Lee |
| 5,822,201 | A | 10/1998 | Kijima |
| 5,825,133 | A | 10/1998 | Conway |
| 5,828,156 | A | 10/1998 | Roberts |
| 5,844,540 | A | 12/1998 | Terasaki |
| 5,854,617 | A | 12/1998 | Lee et al. |
| 5,859,489 | A | 1/1999 | Shimada |
| 5,872,429 | A | 2/1999 | Xia et al. |
| 5,880,946 | A | 3/1999 | Biegel |
| 5,883,473 | A | 3/1999 | Li et al. |
| 5,886,477 | A | 3/1999 | Honbo et al. |
| 5,892,336 | A | 4/1999 | Lin et al. |
| 5,901,176 | A | 5/1999 | Lewison |
| 5,910,709 | A | 6/1999 | Stevanovic et al. |
| 5,910,713 | A | 6/1999 | Nishi et al. |
| 5,912,812 | A | 6/1999 | Moriarty, Jr. et al. |
| 5,914,842 | A | 6/1999 | Sievers |
| 5,923,129 | A | 7/1999 | Henry |
| 5,923,546 | A | 7/1999 | Shimada et al. |
| 5,925,988 | A | 7/1999 | Grave et al. |
| 5,930,121 | A | 7/1999 | Henry |
| 5,930,126 | A | 7/1999 | Griffin et al. |
| 5,936,360 | A | 8/1999 | Kaneko |
| 5,939,830 | A | 8/1999 | Praiswater |
| 6,002,210 | A | 12/1999 | Nilssen |
| 6,011,360 | A | 1/2000 | Gradzki et al. |

6,016,245 A 1/2000 Ross
6,020,688 A 2/2000 Moisin
6,028,400 A 2/2000 Pol et al.
6,037,720 A 3/2000 Wong et al.
6,038,149 A 3/2000 Hiraoka et al.
6,040,661 A 3/2000 Bogdan
6,040,662 A 3/2000 Asayama
6,043,609 A 3/2000 George et al.
6,049,177 A 4/2000 Felper
6,069,448 A 5/2000 Yeh
6,072,282 A 6/2000 Adamson
6,091,209 A 7/2000 Hilgers
6,104,146 A 8/2000 Chou et al.
6,108,215 A 8/2000 Kates et al.
6,111,370 A 8/2000 Parra
6,114,814 A 9/2000 Shannon et al.
6,121,733 A 9/2000 Nilssen
6,127,785 A 10/2000 Williams
6,127,786 A 10/2000 Moisin
6,137,240 A 10/2000 Bogdan
6,144,359 A * 11/2000 Grave ..... 345/102
6,150,772 A 11/2000 Crane
6,157,143 A 12/2000 Bigio et al.
6,160,362 A 12/2000 Shone et al.
6,169,375 B1 1/2001 Moisin
6,172,468 B1 1/2001 Hollander
6,181,066 B1 1/2001 Adamson
6,181,083 B1 1/2001 Moisin
6,181,084 B1 1/2001 Lau
6,188,183 B1 2/2001 Greenwood et al.
6,188,553 B1 2/2001 Moisin
6,194,841 B1 2/2001 Takahashi et al.
6,198,234 B1 3/2001 Henry
6,198,236 B1 3/2001 O'Neill
6,198,238 B1 3/2001 Edelson
6,211,625 B1 4/2001 Nilssen
6,215,256 B1 4/2001 Ju
6,218,788 B1 4/2001 Chen et al.
6,229,271 B1 5/2001 Liu
6,239,558 B1 5/2001 Fujimura et al.
6,252,355 B1 6/2001 Meldrum et al.
6,255,784 B1 7/2001 Weindorf
6,259,215 B1 7/2001 Roman
6,259,615 B1 7/2001 Lin
6,281,636 B1 8/2001 Okutsu et al.
6,281,638 B1 8/2001 Moisin
6,291,946 B1 9/2001 Hinman
6,294,883 B1 9/2001 Weindorf
6,307,765 B1 10/2001 Choi
6,310,444 B1 10/2001 Chang
6,313,586 B1 11/2001 Yamamoto et al.
6,316,881 B1 11/2001 Shannon et al.
6,316,887 B1 11/2001 Ribarich et al.
6,317,347 B1 11/2001 Weng
6,320,329 B1 11/2001 Wacyk
6,323,602 B1 11/2001 De Groot et al.
6,331,755 B1 12/2001 Ribarich et al.
6,340,870 B1 1/2002 Yamashita et al.
6,344,699 B1 2/2002 Rimmer
6,351,080 B1 2/2002 Birk et al.
6,356,035 B1 3/2002 Weng
6,359,393 B1 3/2002 Brown
6,362,577 B1 3/2002 Ito et al.
6,388,388 B1 5/2002 Weindorf et al.
6,396,217 B1 5/2002 Weindorf
6,396,722 B2 5/2002 Lin
6,417,631 B1 7/2002 Chen et al.
6,420,839 B1 7/2002 Chiang et al.
6,424,100 B1 7/2002 Kominami et al.
6,429,839 B1 8/2002 Sakamoto
6,433,492 B1 8/2002 Buonavita
6,441,943 B1 8/2002 Roberts et al.
6,445,141 B1 9/2002 Kastner et al.
6,452,344 B1 9/2002 MacAdam et al.
6,459,215 B1 10/2002 Nerone et al.
6,459,216 B1 10/2002 Tsai
6,469,922 B2 10/2002 Choi
6,472,827 B1 10/2002 Nilssen
6,472,876 B1 10/2002 Notohamiprodjo et al.
6,479,810 B1 11/2002 Weindorf
6,483,245 B1 11/2002 Weindorf
6,486,618 B1 11/2002 Li
6,494,587 B1 12/2002 Shaw et al.
6,495,972 B1 12/2002 Okamoto et al.
6,501,234 B2 12/2002 Lin et al.
6,507,286 B2 1/2003 Weindorf et al.
6,509,696 B2 1/2003 Bruning et al.
6,515,427 B2 2/2003 Oura et al.
6,515,881 B2 2/2003 Chou et al.
6,521,879 B1 2/2003 Rand et al.
6,522,558 B2 2/2003 Henry
6,531,831 B2 3/2003 Chou et al.
6,534,934 B1 3/2003 Lin et al.
6,559,606 B1 5/2003 Chou et al.
6,563,479 B2 5/2003 Weindorf et al.
6,570,344 B2 5/2003 Lin
6,570,347 B2 5/2003 Kastner
6,583,587 B2 6/2003 Ito et al.
6,593,703 B2 7/2003 Sun
6,628,093 B2 9/2003 Stevens
6,630,797 B2 10/2003 Qian et al.
6,633,138 B2 10/2003 Shannon et al.
6,642,674 B2 11/2003 Liao et al.
6,650,514 B2 11/2003 Schmitt
6,654,268 B2 11/2003 Choi
6,664,744 B2 12/2003 Dietz
6,680,834 B2 1/2004 Williams
6,703,998 B1 3/2004 Kabel et al.
6,707,264 B2 3/2004 Lin et al.
6,710,555 B1 3/2004 Terada et al.
6,864,867 B2 3/2004 Biebl
6,717,371 B2 4/2004 Klier et al.
6,717,372 B2 4/2004 Lin et al.
6,717,375 B2 4/2004 Noguchi et al.
6,724,602 B2 4/2004 Giannopoulos
6,765,354 B2 7/2004 Klein
6,781,325 B2 8/2004 Lee
6,784,627 B2 8/2004 Suzuki et al.
6,803,901 B1 10/2004 Numao
6,804,129 B2 10/2004 Lin
6,809,718 B2 10/2004 Wei et al.
6,809,938 B2 10/2004 Lin et al.
6,815,906 B1 11/2004 Aarons et al.
6,816,142 B2 11/2004 Oda et al.
6,856,099 B2 2/2005 Chen et al.
6,856,519 B2 2/2005 Lin et al.
6,870,330 B2 3/2005 Choi
6,876,157 B2 4/2005 Henry
6,897,698 B1 5/2005 Gheorghiu et al.
6,900,599 B2 5/2005 Ribarich
6,900,600 B2 5/2005 Rust et al.
6,900,993 B2 5/2005 Lin et al.
6,922,023 B2 7/2005 Hsu et al.
6,930,893 B2 8/2005 Vinciarelli
6,936,975 B2 8/2005 Lin et al.
6,947,024 B2 9/2005 Lee et al.
6,967,449 B2 11/2005 Ishihara
6,967,657 B2 11/2005 Lowles et al.
6,969,958 B2 11/2005 Henry
6,979,959 B2 12/2005 Henry
7,026,860 B1 4/2006 Gheorghiu et al.
7,057,611 B2 6/2006 Lin et al.
7,075,245 B2 7/2006 Liu
7,095,392 B2 8/2006 Lin
7,120,035 B2 10/2006 Lin et al.
7,151,394 B2 12/2006 Gheorghiu et al.

| | | | |
|---|---|---|---|
| 7,183,724 | B2 | 2/2007 | Ball |
| 7,187,140 | B2 | 3/2007 | Ball |
| 7,190,123 | B2 | 3/2007 | Lee |
| 7,202,458 | B2 | 4/2007 | Park |
| 7,233,117 | B2 | 6/2007 | Wang et al. |
| 7,236,020 | B1 | 6/2007 | Virgil |
| 2001/0036096 | A1 | 11/2001 | Lin |
| 2002/0030451 | A1 | 3/2002 | Moisin |
| 2002/0097004 | A1 | 7/2002 | Chiang et al. |
| 2002/0114114 | A1 | 8/2002 | Schmitt |
| 2002/0118182 | A1 | 8/2002 | Weindorf |
| 2002/0130786 | A1 | 9/2002 | Weindorf |
| 2002/0135319 | A1 | 9/2002 | Bruning et al. |
| 2002/0140538 | A1 | 10/2002 | Yer |
| 2002/0145886 | A1 | 10/2002 | Stevens |
| 2002/0153852 | A1 | 10/2002 | Liao et al. |
| 2002/0171376 | A1 | 11/2002 | Rust et al. |
| 2002/0180380 | A1 | 12/2002 | Lin |
| 2002/0180572 | A1 | 12/2002 | Kakehashi et al. |
| 2002/0181260 | A1 | 12/2002 | Chou et al. |
| 2002/0195971 | A1 | 12/2002 | Qian et al. |
| 2003/0001524 | A1 | 1/2003 | Lin et al. |
| 2003/0020677 | A1 | 1/2003 | Nakano |
| 2003/0025462 | A1 | 2/2003 | Weindorf |
| 2003/0080695 | A1 | 5/2003 | Ohsawa |
| 2003/0090913 | A1 | 5/2003 | Che-Chen et al. |
| 2003/0117084 | A1 | 6/2003 | Stack |
| 2003/0141829 | A1 | 7/2003 | Yu |
| 2003/0161164 | A1 | 8/2003 | Shannon et al. |
| 2003/0227435 | A1 | 12/2003 | Hsieh |
| 2004/0000879 | A1 | 1/2004 | Lee |
| 2004/0012556 | A1 | 1/2004 | Yong et al. |
| 2004/0017348 | A1 | 1/2004 | Numao |
| 2004/0032223 | A1 | 2/2004 | Henry |
| 2004/0051473 | A1 | 3/2004 | Jales et al. |
| 2004/0145558 | A1 | 7/2004 | Cheng |
| 2004/0155596 | A1 | 8/2004 | Ushijima |
| 2004/0155853 | A1 | 8/2004 | Lin |
| 2004/0189217 | A1 | 9/2004 | Ishihara et al. |
| 2004/0227719 | A1* | 11/2004 | Chang et al. ..... 345/102 |
| 2004/0257003 | A1 | 12/2004 | Hsieh et al. |
| 2004/0263092 | A1 | 12/2004 | Liu |
| 2005/0057484 | A1* | 3/2005 | Diefenbaugh et al. ..... 345/102 |
| 2005/0062436 | A1 | 3/2005 | Jin |
| 2005/0093471 | A1 | 5/2005 | Jin |
| 2005/0093472 | A1 | 5/2005 | Jin |
| 2005/0093482 | A1 | 5/2005 | Ball |
| 2005/0093483 | A1 | 5/2005 | Ball |
| 2005/0093484 | A1 | 5/2005 | Ball |
| 2005/0099143 | A1 | 5/2005 | Kohno |
| 2005/0156536 | A1 | 7/2005 | Ball |
| 2005/0156539 | A1 | 7/2005 | Ball |
| 2005/0156540 | A1 | 7/2005 | Ball |
| 2005/0162098 | A1 | 7/2005 | Ball |
| 2005/0218825 | A1 | 10/2005 | Chiou |
| 2005/0225261 | A1 | 10/2005 | Jin |
| 2006/0022612 | A1 | 2/2006 | Henry |
| 2006/0049959 | A1 | 3/2006 | Sanchez |
| 2006/0158136 | A1 | 7/2006 | Chen |

FOREIGN PATENT DOCUMENTS

| | | |
|---|---|---|
| EP | 0587923 | 3/1994 |
| EP | 0597661 | 5/1994 |
| EP | 0647021 | 9/1994 |
| JP | 06168791 | 6/1994 |
| JP | 8-204488 | 8/1996 |
| KR | 10-2003-0075461 | 10/2003 |
| TW | 554643 | 9/2003 |
| TW | 8-204488 | 12/2003 |
| TW | 200501829 | 1/2005 |
| WO | WO 94/15444 | 7/1994 |
| WO | WO 98/09369 | 3/1998 |
| WO | WO 9941953 | 8/1999 |
| WO | WO 0237904 | 5/2002 |

OTHER PUBLICATIONS

UNITRODE Datasheet, Resonant Fluorescent Lamp Driver, UC 1871/2871/3871, May 1993, pp. 1-6.

UNITRODE Product & Applications Handbook 1993-94, U-141, Jun. 1993, pp. i-ii; 9-471-9-478.

Williams, Jim, Techniques for 92% Efficient LCD Illumination, Linear Technology Application Note 55, Aug. 1993.

Unitrode Datasheet, Resonant Fluorescent Lamp Driver, UC 1871/2871/3871, Oct. 1994, pp. 1-6.

O'Connor, J., Dimmable Cold-Cathode Fluorescent Lamp Ballast Design Using the UC3871, Application Note U-148, pp. 1-15,1995.

Goodenough, Frank, DC-to-AC Inverter Ups CCFL Lumens Per Watt, Electronic Design, Jul. 10, 1995, pp. 143-148.

Coles, Single Stage CCFL Backlight Resonant Inverter using PWM Dimming Methods, 1998, pp. 35-38.

Micro Linear, ML4878 Single-Stage CCFL Backlight Resonant Inverter, Application Note 68, May 1998, pp. 1-12.

Plaintiff O2 Micro International Limited's Preliminary Invalidity Contentions re Third-Party Defendant Microsemi Corporation Patents, dated Sep. 14, 2007.

Third-Party Defendant Microsemi Corporation's Brief in Support of its Claim Construction for U.S. Patent Nos. 5,930,121 and 6,198,234, dated Oct. 19, 2007.

Declaration of Irfan A. Lateef in Support of Third-Party Defendant Microsemi Corporation's Brief in Support of its Claim Construction for U.S. Patent Nos. 5,930,121 and 6,198,234, dated Oct. 19, 2007.

Plaintiff O2 Micro International Limited's Brief in Response to Third-Party Defendant Microsemi Corporation's Brief Re Claim Construction for U.S. Patent Nos. 5,930,121 and 6,198,234, dated Oct. 26, 2007.

Declaration of Henry C. Su in Support of Plaintiff 02 Micro International Limited's Brief in Response to Third-Party Defendant Microsemi Corporation's Brief Re Claim Construction for U.S. Patent Nos. 5,930,121 and 6,198,234, dated Oct. 26, 2007.

Defendant/Counterclaimant Monolithic Power Systems, Inc.'s Notice of Motion and Motion for Summary Judgment of Invalidity of Asserted Claims of U. S. Patent No. 6,198,234, dated Nov. 14, 2005.

Defendant/Counterclaimant Monolithic Power Systems, Inc.'s Memorandum of Points and Authorities in Support of Motion for Summary Judgment of Invalidity of Asserted Claims of U. S. Patent No. 6,198,234, dated Nov. 14, 2005.

Declaration of Robert Mammano filed by Defendant/Counterclaimant Monolithic Power Systems, Inc.'s in Support of Its Motion for Summary Judgment of Invalidity of Asserted Claims of U. S. Patent No. 6,198,234, dated Nov. 14, 2005.

Declaration of John A. O'Connor filed by Defendant/Counterclaimant Monolithic Power Systems, Inc.'s in Support of Its Motion for Summary Judgment of Invalidity of Asserted Claims of U. S. Patent No. 6,198,234, dated Nov. 14, 2005.

Declaration of Defendant/Counterclaimant Monolithic Power Systems, Inc.'s Expert Witness, Dr. Douglas C. Hopkins, In Support of Its Motion for Summary Judgment of Invalidity of Asserted Claims of U. S. Patent No. 6,198,234, dated Nov. 14, 2005.

Declaration of Doyle Slack filed by Defendant/Counterclaimant Monolithic Power Systems, Inc.'s in Support of Its Motion for Summary Judgment of Invalidity of Asserted Claims of U. S. Patent No. 6,198,234, dated Nov. 14, 2005.

Declaration of Dean G. Dunlavey filed by Defendant/Counterclaimant Monolithic Power Systems, Inc.'s in Support of Its Motion for Summary Judgment of Invalidity of Asserted Claims of U. S. Patent No. 6,198,234, dated Nov. 14, 2005.

Declaration of Charles Coles filed by Defendant/Counterclaimant Monolithic Power Systems, Inc.'s in Support of Its Motion for Summary Judgment of Invalidity of Asserted Claims of U. S. Patent No. 6,198,234, dated Nov. 14, 2005.

Plaintiff Microsemi Corporation's Opposition to Defendant/Counterclaimant Monolithic Power Systems, Inc.'s Motion for Summary Judgment of Invalidity of Asserted Claims of U.S. Patent No. 6,198,234, dated Feb. 13, 2006.

Plaintiff Microsemi Corporation's Statement of Genuine Issues in Opposition to Defendant/Counterclaimant Monolithic Power Systems, Inc.'s Motion for Summary Judgment of Invalidity of Asserted Claims of U.S. Patent No. 6,198,234, dated Feb. 13, 2006.

Defendant/Counterclaimant Monolithic Power Systems, Inc.'s Reply Brief in Support of Motion for Summary Judgment of Invalidity of Asserted Claims of U. S. Patent No. 6,198,234, dated Mar. 13, 2006.

Supplemental Declaration of Dean G. Dunlavey filed by Defendant/Counterclaimant Monolithic Power Systems, Inc.'s in Support of Its Motion for Summary Judgment of Invalidity of Asserted Claims of U. S. Patent No. 6,198,234, dated Mar. 13, 2006.

Defendant/Counterclaimant Monolithic Power Systems, Inc.'s Notice of Motion and Motion for Summary Judgment of Invalidity of Asserted Claims of U. S. Patent No. 5,615,093, dated Nov. 14, 2005.

Defendant/Counterclaimant Monolithic Power Systems, Inc.'s Memorandum of Points and Authorities in Support of Motion for Summary Judgment of Invalidity of Asserted Claims of U. S. Patent No. 5,615,093, dated Nov. 14, 2005.

Plaintiff Microsemi Corporation's Opposition to Defendant/Counterclaimant Monolithic Power Systems, Inc.'s Motion for Summary Judgment of Invalidity of Asserted Claims of U.S. Patent No. 5,615,093, dated Feb. 13, 2006.

Plaintiff Microsemi Corporation's Statement of Genuine Issues in Opposition to Defendant/Counterclaimant Monolithic Power Systems, Inc.'s Motion for Summary Judgment of Invalidity of Asserted Claims of U.S. Patent No. 5,615,093, dated Feb. 13, 2006.

Defendant/Counterclaimant Monolithic Power Systems, Inc.'s Reply Brief in Support of Motion for Summary Judgment of Invalidity of Asserted Claims of U. S. Patent No. 5,615,093, dated Mar. 13, 2006.

Nguyen, Don J., "Optimizing Mobile Power Delivery". Presented at Intel Developers Forum, Fall 2001, p. 4.

Tannas, Lawrence, "Flat Panel Displays and CRTs". © 1985 Van Nostrand Reinhold Company Inc., pp. 96-99.

Tannas, Lawrence, "Flat Panel Displays and CRT's". 1985 Van Nostrand Reinhold Company, Inc., pp. 96-99.

Williams, B.W.; "Power Electronics Devices, Drivers, Applications and Passive Components"; Second Edition, McGraw-Hill, 1992; Chapter 10, pp. 218-249.

Bradley, D.A., "Power Electronics" 2nd Edition; Chapman & Hall, 1995; Chapter 1, pp. 1-38.

Dubey, G. K., "Thyristorised Power Controllers"; Halsted Press, 1986; pp. 74-77.

IEEE Publication, "Dual Switched Mode Power Converter": Pallab Midya & Fred H. Schlereth; p. 155 1989.

IEEE Publication, "High Frequency Resonant Inverter for Group Dimming Control of Fluorescent Lamp Lighting Systems", K.H. Jee, et al., 1989 149-154.

Int. J. Electronics, "New soft-switching inverter for high efficiency electronic ballast with simple structure" E.C. Nho, et al., 1991, vol. 71, No. 3, 529-541.

PCT International Search Report and Written Opinion mailed Apr. 8, 2008, Appl. No. PCT/US2007/072862 in 12 pages.

* cited by examiner

DUAL-SLOPE BRIGHTNESS CONTROL FOR TRANSFLECTIVE DISPLAYS

CLAIM FOR PRIORITY

This application claims the benefit of priority under 35 U.S.C. §119(e) of U.S. Provisional Application No. 60/577,645, filed on Jun. 7, 2004, and entitled "Dual-Slope Brightness Control For Transflective Displays," the entirety of which is incorporated herein by reference.

BACKGROUND OF THE INVENTION

1. Field of the Invention

The present invention relates to brightness control in a transflective display, and more particularly relates to different adjustments of the backlight brightness level for different ranges of ambient light levels for improved power efficiency.

2. Description of the Related Art

A transflective color liquid crystal display (LCD) has two modes of illumination. In low ambient light conditions, a backlight can greatly enhance the legibility of the display. In bright ambient light conditions, the surface of the display reflects the ambient light and the reflected light is the primary source of illumination. The effect of the backlight becomes insignificant when the ambient light is sufficiently bright.

One method to conserve power is to shut off the backlight abruptly when the ambient light reaches a level at which the reflective light is strong enough to fully illuminate the display. To ensure that the switchover is not noticeable to the user, the backlight generally does not turn off until the ambient light is relatively high.

SUMMARY OF THE INVENTION

The present invention improves power efficiency in a transflective display (e.g., a transflective color LCD) by using dual-slope brightness control. For example, a backlight is dimmed to conserve power while providing enough light to illuminate the transflective display under relatively low ambient light conditions. As ambient light increases, the backlight intensity increases to continue providing enough light for a legible display. In one embodiment, the backlight reaches a predetermined (e.g., maximum) intensity at a predefined ambient light level (e.g., at approximately 1000 Lux) and no longer increases with increasing ambient light. As the ambient light increases above the predefined ambient light level, reflected light starts to influence the transflective display in a positive nature and eventually overpowers the effects of the backlight.

It is advantageous to turn off the backlight to conserve power under relatively high ambient light conditions. The effect on the transflective display associated with shutting off the backlight abruptly may be unappealing to a display viewer. To ensure that the switchover in illumination from backlight to reflected light is gradual and less noticeable to the display viewer, the backlight is turned down gradually over a range of ambient light conditions that is optimum for a particular transflective display.

In one embodiment, a method to control brightness in a transflective display includes sensing ambient light with a visible light detector. The visible light detector outputs a current signal that varies linearly with the ambient light level. A backlight intensity of the transflective display increases proportionately (or linearly) with increasing ambient light levels for a first range of ambient light levels and decreases proportionately with increasing ambient light levels for a second range of ambient light levels. The second range of ambient light levels is higher than the first range of ambient light levels.

The first range of ambient light levels corresponds to relatively low ambient light conditions (e.g., indoor lighting) in which the backlight is the primary source of display illumination. The backlight increases with increasing ambient light levels in the first range of ambient light levels to maintain a constant level of Pixel Contrast Ratio and to minimize backlight power consumption as discussed in commonly-owned pending U.S. patent application Ser. No. 11/023,295, entitled "Method and Apparatus to Control Display Brightness with Ambient Light Correction," which is hereby incorporated by reference herein.

The second range of ambient light levels corresponds to relatively higher ambient light conditions in which both the reflected ambient light and the backlight influence the display illumination. For example, the reflected ambient light is noticeable but may not be capable of fully illuminating the transflective display. The backlight remains active and its intensity gradually reduces as the ambient light increases in the second range of ambient light levels. Gradual reduction of the backlight intensity as the reflected light increases in the second range of ambient light levels saves power and extends battery life.

In one embodiment, the method further includes maintaining the backlight intensity at an approximately constant level for a third range of ambient light levels that is between the first range of ambient light levels and the second range of ambient light levels. In another embodiment, the method further includes turning off the backlight for a fourth range of ambient light levels that is higher than the second range of ambient light levels. In the fourth range of ambient light levels (e.g., sunlight), the reflected ambient light dominates the display illumination and the backlight is turned off as the reflected ambient light is sufficient to fully illuminate the transflective display. In one embodiment, the first range of ambient light levels is approximately 0-1000 Lux, the second range of ambient light levels is approximately 2000-3000 Lux, the third range of ambient light levels is approximately 1000-2000 Lux and the fourth range of ambient light levels is greater than 3000 Lux.

In one embodiment, a backlight brightness control system for a transflective display includes a light sensor and a dual-slope circuit. The light sensor detects ambient light and outputs a signal indicative of the ambient light level. The dual-slope circuit is coupled to the output of the light sensor and generates a brightness control signal that increases backlight intensity with increasing ambient light levels for a first range of ambient light levels and decreases the backlight intensity with increasing ambient light levels for a second range of ambient light levels. The first range of ambient light levels is lower than the second range of ambient light levels. In one embodiment, the brightness control signal is approximately constant for a third range of ambient light levels that is between the first range of ambient light levels and the second range of ambient light levels. In another embodiment, the brightness control signal is approximately zero or negative when the ambient light level is above a predetermined level (e.g., above an upper limit in the second range of ambient light levels).

In one embodiment, the dual-slope circuit includes a summing circuit, a linear amplifier and a comparator. The summing circuit combines a first input and a second input to generate the brightness control signal. A first signal is provided to the first input. In one embodiment, the first signal increases linearly with increasing ambient light levels for the first range of ambient light levels and is approximately constant for the second range of ambient light levels. The linear amplifier outputs a second signal that is proportional to a difference between the output of the light sensor and a threshold signal corresponding to a lower limit of the second range of ambient light levels. The second signal is selectively coupled to the second input of the summing circuit when the output of the light sensor is greater than the threshold signal as determined by the comparator.

In one embodiment, the backlight brightness control system further includes a multiplier circuit that generates the first signal based on a product of a dimming control input and the output of the light sensor. The backlight brightness control system can also include a dark bias level signal to maintain the first signal above a predetermined level when the ambient light level is approximately zero (or corresponds to total darkness). In addition, a clamp circuit can be used to limit the first signal to be less than a predefined level to avoid overdriving the backlight intensity.

In another embodiment, the dual-slope circuit includes a first current-mirror circuit, a second current-mirror circuit and an output transistor. The first current-mirror circuit is coupled to the output of the light sensor and generates a source current that is proportional to the output of the light sensor for the first range of ambient light levels. In one embodiment, the source current is approximately constant for ambient light levels above the first range of ambient light levels. The source current is provided to an emitter terminal of the output transistor via a series resistor. The second current-mirror circuit is also coupled to the output of the light sensor and generates a sink current that is proportional to the output of the light sensor. The sink current is provided to the emitter terminal of the output transistor via a series diode.

The output transistor conducts an output current at a collector terminal. The output current corresponds to the brightness control signal. In one embodiment, the output current is combined with a dimming control input to adjust brightness for a backlight driver. For example, a product of the output current and a user defined dimming signal is provided to a backlight controller for adjusting the backlight intensity of a transflective display.

In one embodiment, the series diode has an anode coupled to the emitter terminal of the output transistor and a cathode coupled to an output of the second current-mirror circuit. A pull-up resistor is coupled between the output of the second current-mirror circuit and a supply voltage. The series diode is non-conductive and the output current is approximately the source current for the first range of ambient light levels. The series diode is conductive and the output current is approximately a difference between the source current and the sink current for the second range of ambient light levels. An upper limit for the first range of ambient light levels is programmable by adjusting the value of the series resistor and a lower limit on the second range of ambient light levels is programmable by adjusting the value of the pull-up resistor.

For the purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF THE EMBODIMENT

Figure 1:
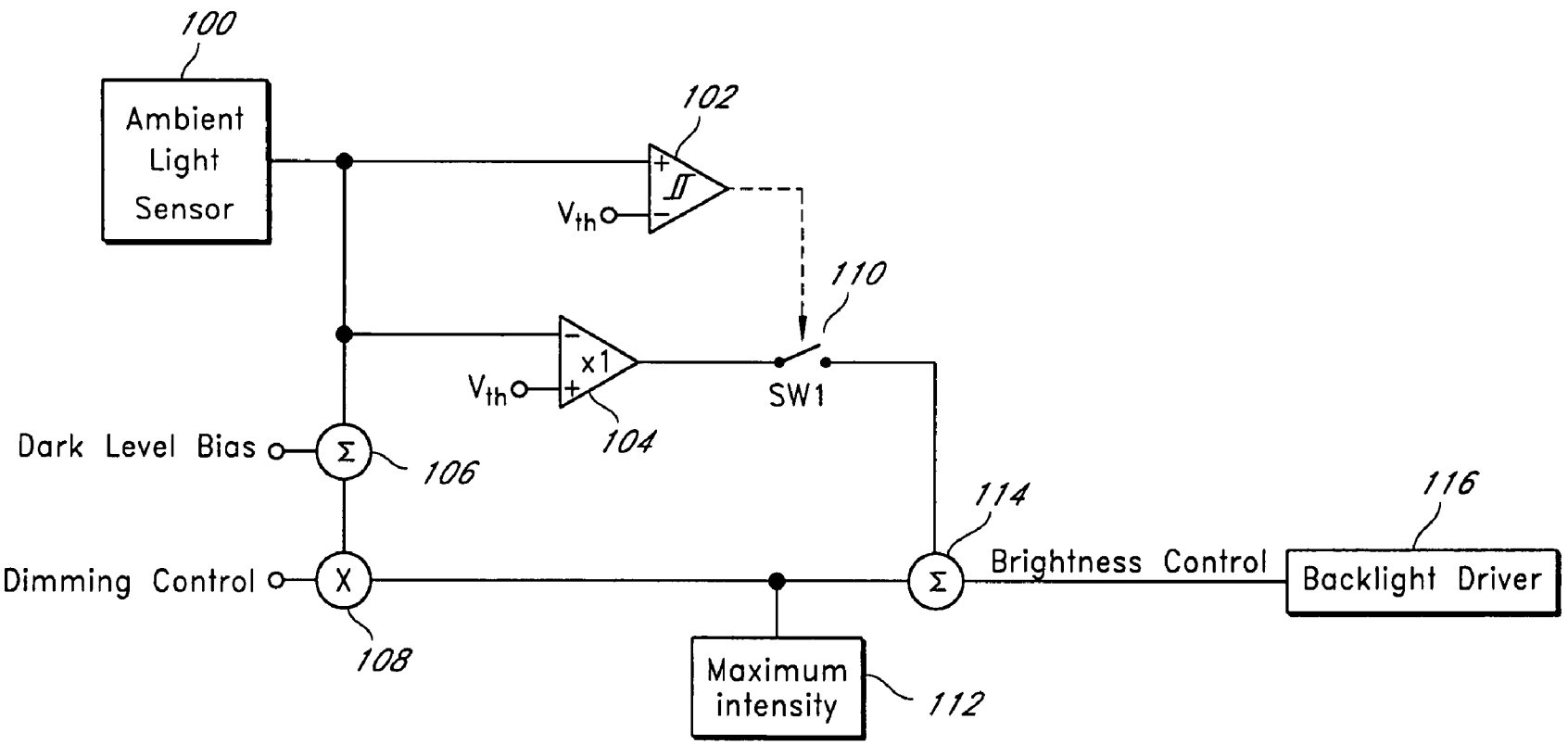
FIG. 1 illustrates one embodiment of a dual-slope brightness control circuit.

Embodiments of the present invention will be described hereinafter with reference to the drawings. FIG. 1 illustrates one embodiment of a dual-slope brightness control circuit. The dual-slope brightness control circuit includes a comparator 102, a difference (or linear) amplifier 104 and a summing circuit 114. In one embodiment, an ambient light sensor 100 outputs a sensed signal (e.g., a current or a voltage signal) that is proportional to the ambient light level. The sensed signal is provided to a non-inverting input of the comparator 102 and an inverting input of the difference amplifier 104. A threshold signal (e.g., a voltage or Vth) corresponding to a predetermined ambient light level is provided to an inverting input of the comparator 102 and a non-inverting input of the difference amplifier 104.

In one embodiment, an output of the difference amplifier 104 is coupled to a second input of the summing circuit 114 via a series switch (SW1) 110. An output of the comparator 102 controls the series switch 110. For example, when the comparator 102 determines that the sensed signal is less than the threshold signal, the series switch 110 is opened to isolate the output of the difference amplifier 104 from the summing circuit 114. When the comparator 102 determines that the sensed signal is greater than the threshold signal, the series switch 110 is closed to couple the output of the difference amplifier 104 to the second input of the summing circuit 114.

The sensed signal is coupled to a first input of the summing circuit 114 and the summing circuit 114 outputs a brightness control signal to a backlight driver 116. In one embodiment, the sensed signal is combined with a dimming control signal determined by a user before being provided to the first input of the summing circuit 114. For example, the sensed signal and the dimming control signal is provided to a multiplier circuit 108 which outputs a product of the sensed signal and the dimming control signal to the first input of the summing circuit 114.

In one embodiment, a dark level bias signal is added to the sensed signal by a summing circuit 106 before being provided to the multiplier circuit 108. The dark level bias signal ensures a predefined level of backlight intensity when the ambient light level is approximately zero (or in total darkness). In one embodiment, a clamp circuit (Maximum intensity) 112 is coupled to the first input of the summing circuit 112 to avoid overdriving (or damaging) the backlight by limiting the amplitude of the signal at the first input. Further details of the multiplier circuit 108, various ways to combine the sensed signal with a user-defined dimming input and dark level bias signal, and the clamp circuit 112 are discussed in commonly-owned pending U.S. patent application Ser. No. 11/023,295, entitled "Method and Apparatus to Control Display Brightness with Ambient Light Correction," which is hereby incorporated by reference herein.

The brightness control signal of the dual-slope brightness control circuit described above advantageously increases with increasing ambient light levels for a first range of ambient light levels and decreases with increasing ambient light levels for a second range of ambient light levels for efficient backlight operation of a visual display (e.g., transflective display). For example, when the ambient light level is below the predetermined level (e.g., 2000 Lux) corresponding to the threshold signal, the output of the comparator 102 is logic low, the series switch 110 is opened and the brightness control signal is approximately equal to or a scaled version of the first input of the summing circuit 114.

The signal at the first input of the summing circuit 114 is a combination of the sensed signal from the output of the ambient light sensor 100 and the dimming control signal selectable (or defined) by a user. In one embodiment, the dimming control signal has an amplitude ranging from zero to one to indicate user preference. In one embodiment, the sensed signal is approximately zero in total ambient darkness and the summing circuit 106 adds the dark level bias signal to the sensed signal to prevent the backlight from turning off in total ambient darkness. The multiplier circuit 108 multiplies the dimming control signal with the combination of the dark level bias signal and the sensed signal to generate the signal at the first input of the summing circuit 114. The signal at the first input of the summing circuit 114 is limited in amplitude by the clamp circuit 112. Thus, the signal at the first input of the summing circuit 114 increases with increasing ambient light levels as indicated by the sensed signal and reaches a plateau at a predetermined ambient light level determined by the clamp circuit 112.

In one embodiment, the predetermined ambient light level (e.g., 1000 Lux) determined by the clamp circuit 14 is lower than the predetermined ambient level (e.g., 2000 Lux) corresponding to the threshold signal. Thus, the brightness control signal at the output of the summing circuit 114 increases with increasing ambient light levels for the first range of ambient light levels (e.g., 0-1000 Lux) and then stays approximately constant until the ambient light level reaches the predetermined ambient light level corresponding to the threshold signal (e.g., 1000-2000 Lux). When the sensed signal indicates that the ambient light level is approximately equal to or greater than the predetermined ambient light level corresponding to the threshold signal, the output of the comparator 102 closes the series switch 110 to provide the output of the difference amplifier 104 to the second input of the summing circuit 114. The output of the difference amplifier 104 decreases with increasing ambient light levels. With the signal at the first input of the summing circuit 114 approximately constant, the brightness control signal at the output of the summing circuit 114 decreases with increasing ambient light levels for the second range of ambient light levels (e.g., above 2000 Lux). Eventually, the brightness control signal becomes approximately zero (e.g., at approximately 3000 Lux) and the backlight is extinguished (or turned off) and further increases in ambient light has no effect on the backlight.

The first range of ambient light levels in which the brightness control signal (or backlight intensity) increases with increasing ambient light levels and the second range of ambient light levels in which the brightness control signal decreases with increasing ambient light levels are advantageously programmable to suit particular transflective displays. For example, an upper limit of the first range of ambient light levels can be adjusted by adjusting the clamp circuit 112. A lower limit of the second range of ambient light levels can be adjusted by adjusting the threshold signal. An upper limit of the second range of ambient light levels can be adjusted by adjusting the gain of the difference amplifier 104. For example, the gain of the difference amplifier 104 can be varied (e.g., between 0.5 and 2) depending on display characteristics to provide a more gradual or a more abrupt decrease in backlight intensity as the ambient light increases in the second range of ambient light levels.

Figure 2:
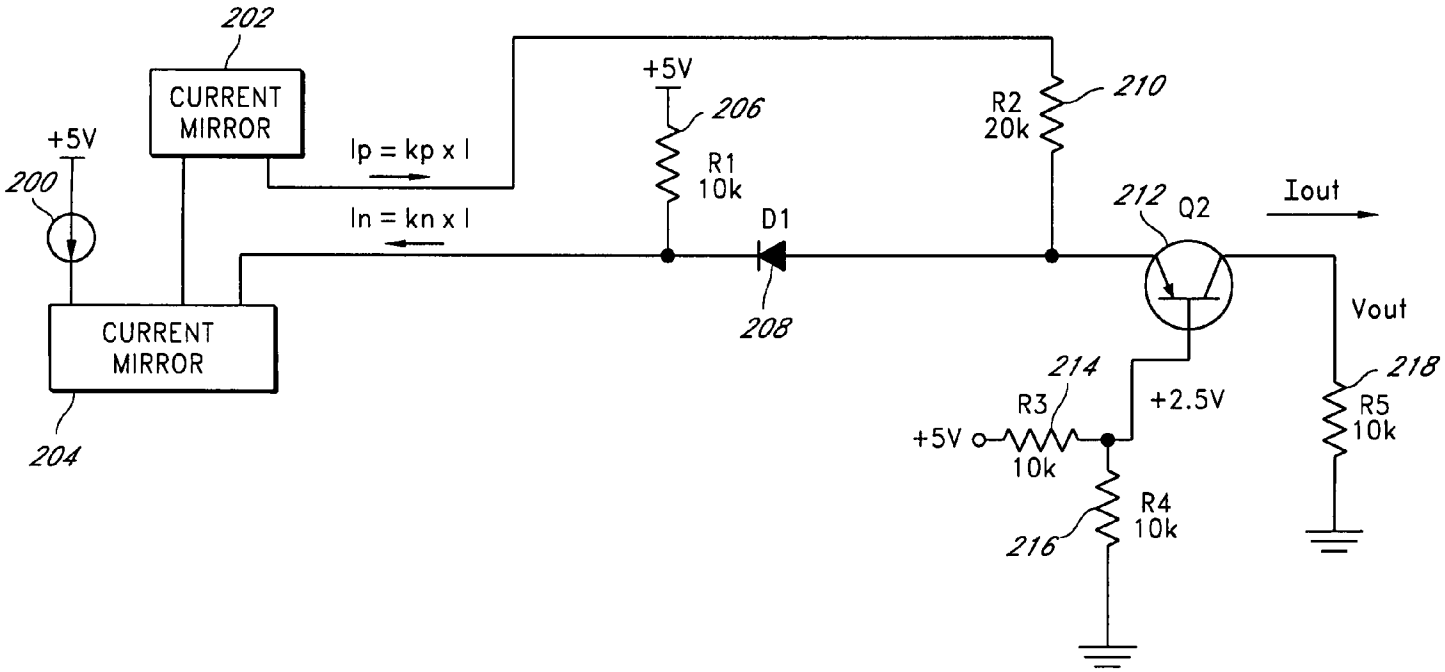
FIG. 2 illustrates another embodiment of a dual-slope brightness control circuit.

FIG. 2 illustrates another embodiment of a dual-slope brightness control circuit. The dual-slope brightness control circuit includes a first current-mirror circuit 202, a second current-mirror circuit 204 and an output transistor (Q2) 212. In one embodiment, a light sensor 200 detects ambient light and outputs a reference current that tracks ambient light levels. The reference current is used by the first current-mirror circuit 202 and the second current-mirror circuit 204 to respectively generate a source current (Ip) and a sink current (In). For example, the light sensor 200 is coupled between a supply voltage (e.g., +5 Volts) and an input of the second current-mirror circuit 204. An input of the first current-mirror circuit 202 can be coupled to the light sensor 200 or to the second current-mirror circuit 204 as shown in FIG. 2. An output of the first current-mirror circuit 202 conducts the source current and an output of the second current-mirror circuit 204 conducts the sink current. The source and sink currents are scaled to the reference current:

$$Ip=Kp\times I\mathrm{ref}$$

$$In=Kn\times I\mathrm{ref}$$

The terms "Kp" and "Kn" are scalars, and the term "Iref" corresponds to the reference current (or output of the light sensor 200). Thus, the source and sink currents are proportional to the level (or intensity) of ambient light incident on the light sensor 200. The dual-slope brightness control circuit generates an output current (Iout) from the source and sink currents.

Figure 3:
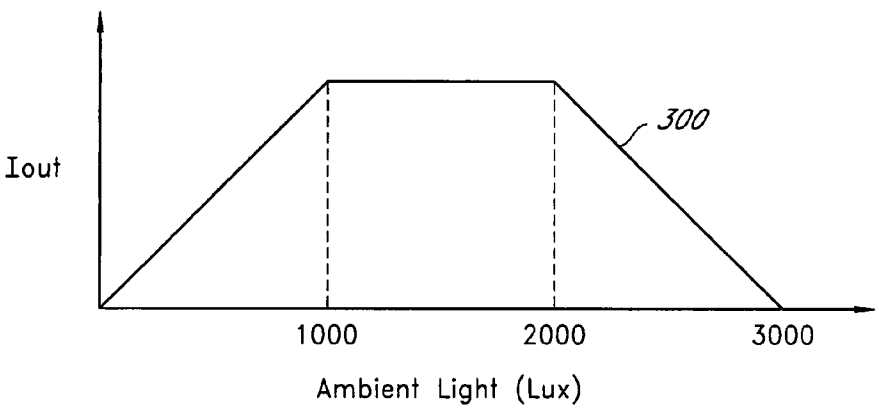
FIG. 3 illustrates an output waveform for the dual-slope brightness control circuit of FIG. 2.

In one embodiment, the output current has a plateau-shaped response to increasing ambient light as shown in FIG. 3. A graph 300 shows the output current with respect to ambient light intensity (or Lux). The output current has a rising portion (or slope) for a first range of ambient light intensity (or levels), a falling portion for a second range of ambient light intensity and a flat portion (or slope) for a third range of ambient light intensity. The transitions or ranges of ambient light intensity for the rising portion, the flat portion and the falling portion are advantageously programmable to provide a desired profile.

In one embodiment, the first range of ambient light levels corresponds to relatively low ambient light levels (e.g., 0-1000 Lux) and the output current is approximately equal to the source current (or positive current) which increases with increasing ambient light. In the embodiment shown in FIG. 2, the output current is conducted by a collector terminal of the output transistor 212. The output (or source current) of the first current-mirror circuit 202 is provided to an emitter terminal of the output transistor 212 via a series resistor (R2) 210. A resistor divider circuit, comprising of R3 214 and R4 216, is coupled to the supply voltage and provides a bias voltage (e.g, +2.5 Volts) to a base terminal of the output transistor 212.

The output (or sink current) of the second current-mirror circuit 204 is provided to the emitter terminal of the output transistor 212 via a series diode (D1) 208. The series diode 208 has an anode coupled to the emitter terminal of the output transistor 212 and a cathode coupled to the output of the second current-mirror circuit 204. A pull-up resistor (R1) 206 is coupled between the supply voltage and the output of the second current-mirror circuit 204. The sink current (or negative current) increases in amplitude with increasing ambient light. The amplitude of the sink current is relatively low in the first range of ambient light levels and the voltage at the cathode of the series diode 208 is sufficiently high to ensure that the series diode 208 is off to thereby isolate the output of the second current-mirror circuit 204 from the output transistor 212.

In one embodiment, the third range of ambient light levels corresponds to relatively medium ambient light levels (e.g., 1000-2000 Lux) in which the output current stays flat (or approximately constant) as the ambient light level varies. In the first range of ambient light levels, the voltage across the series resistor 210 increases as the positive current increases with increasing ambient light levels. The flat portion of the output current (or the third range of ambient light levels) begins when the increasing voltage across the series resistor 210 causes the first current-mirror circuit 202 to run out of headroom and the positive current no longer increases with increasing ambient light. The transition point between the rising portion and the flat portion of the output current can be adjusted by changing the value of the series resistor 210.

In one embodiment, the second range of ambient light levels corresponds to relatively high ambient levels (e.g., greater than 2000 Lux) in which the output current decreases with increasing ambient light levels. The falling portion of the output current begins when the series diode 208 starts to conduct. The series diode 208 starts to conduct when the negative current conducted by the pull-up resistor 206 increases in amplitude to cause a sufficient drop in voltage at the cathode of the series diode 208 (e.g., when the cathode is below 2.5 Volts). The current conducted by the series diode 208 is taken from (or reduces) the output current and is approximately the negative current in the second range of ambient light levels. Thus, the output current is approximately equal to a difference between the positive current and the negative current in the second range of ambient light levels. Since the positive current is substantially constant and the negative current increases in amplitude with increasing ambient light levels, the output current decreases with increasing ambient light levels in the second range of ambient light levels. Eventually, the output current decreases to approximately zero and the backlight is accordingly turned off and not affected by further increases in ambient light. The transition point between the flat portion and the falling portion of the output current (or lower limit in the second range of ambient light levels) can be adjusted by changing the value of the pull-up resistor 206.

In one embodiment, the output current is provided to a backlight controller to adjust backlight brightness. For example, the output current can be scaled by a resistor (R5) 218 coupled to the collector terminal of the output transistor 212 to generate an output voltage to drive a backlight controller brightness adjustment. In another embodiment, the output current is provided to a light sensor multiplier circuit first to take into account user dimming settings. Further details of the light sensor multiplier circuit are discussed in the commonly-owned pending U.S. patent application described above.

While certain embodiments of the inventions have been described, these embodiments have been presented by way of example only, and are not intended to limit the scope of the inventions. Indeed, novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A backlight brightness control system for a visual display comprising:

a light sensor configured to detect ambient light and to output a signal indicative of the ambient light level; and an electronic circuit coupled to the output of the light sensor and configured to generate a brightness control signal that increases backlight intensity of the visual display with increasing ambient light levels for a first range of ambient light levels and decreases the backlight intensity of the visual display with increasing ambient light levels for a second range of ambient light levels, wherein the first range of ambient light levels is lower than the second range of ambient light levels, wherein the electronic circuit further comprises:

a summing circuit that combines a first input with a second input to generate the brightness control signal, wherein a first signal is provided to the first input and the first signal increases linearly with increasing ambient light levels for the first range of ambient light levels and is approximately constant for the second range of ambient light levels;

a linear amplifier configured to output a second signal proportional to a difference between the output of the light sensor and a threshold signal corresponding to a lower limit of the second range of ambient light levels; and a comparator configured to compare the output of the light sensor with the threshold signal, wherein the second signal is selectively coupled to the second input of the summing circuit when the output of the light sensor is greater than the threshold signal.

2. The backlight brightness control system of claim 1, further comprising a multiplier circuit configured to generate the first signal based on a product of a dimming control input and the output of the light sensor.

3. The backlight brightness control system of claim 2, wherein a dark bias level signal is included to maintain the first signal above a predetermined level when the ambient light level is approximately zero.

4. The backlight brightness control system of claim 2, further comprising a clamp circuit configured to limit the first signal to be less than a predefined level.

5. A backlight brightness control system for a visual display comprising:

a light sensor configured to detect ambient light and to output a signal indicative of the ambient light level; and an electronic circuit coupled to the output of the light sensor and configured to generate a brightness control signal that increases backlight intensity of the visual display with increasing ambient light levels for a first range of ambient light levels and decreases the backlight intensity of the visual display with increasing ambient light levels for a second range of ambient light levels, wherein the first range of ambient light levels is lower than the second range of ambient light levels, wherein the electronic circuit further comprises:

a first current-mirror circuit coupled to the output of the light sensor and configured to generate a source current that is proportional to the output of the light sensor for the first range of ambient light levels, wherein the source current is approximately constant for ambient light levels above the first range of ambient light levels;

a second current-mirror circuit coupled to the output of the light sensor and configured to generate a sink current that is proportional to the output of the light sensor; and an output transistor configured to conduct an output current at a collector terminal corresponding to the brightness control signal, wherein the source current is provided to an emitter terminal of the output transistor via a series resistor, the sink current is provided to the emitter terminal of the output transistor via a series diode.

6. The backlight brightness control system of claim 5, wherein a product of the output current and a user dimming signal is provided to a backlight controller for adjusting the backlight intensity of the visual display.

7. The backlight brightness control system of claim 5, wherein the series diode has an anode coupled to the emitter terminal of the output transistor and a cathode coupled to an output of the second current-mirror circuit, a pull-up resistor is coupled between the output of the second current-mirror circuit and a supply voltage, the series diode is non-conductive and the output current is approximately the source current for the first range of ambient light levels, and the series diode is conductive and the output current is approximately a difference between the source current and the sink current for the second range of ambient light levels.

8. The backlight brightness control system of claim 7, wherein an upper limit for the first range of ambient light levels is programmable by adjusting the value of the series resistor and a lower limit for the second range of ambient light levels is programmable by adjusting the value of the pull-up resistor.

* * * * *